US009801449B2

(12) United States Patent
Lequeux et al.

(10) Patent No.: US 9,801,449 B2
(45) Date of Patent: Oct. 31, 2017

(54) TWO-PART APPLICATOR FOR A COSMETIC PRODUCT

(71) Applicant: ALBEA SERVICES, Gennevilliers (FR)

(72) Inventors: Vincent Lequeux, Paris (FR); Aurélie Badie, Pontoise (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 14/655,084

(22) PCT Filed: Dec. 20, 2013

(86) PCT No.: PCT/EP2013/077868
§ 371 (c)(1),
(2) Date: Jun. 24, 2015

(87) PCT Pub. No.: WO2014/102224
PCT Pub. Date: Jul. 3, 2014

(65) Prior Publication Data

US 2015/0342322 A1 Dec. 3, 2015

(30) Foreign Application Priority Data

Dec. 27, 2012 (FR) ..... 12 62825

(51) Int. Cl.
*A45D 34/06* (2006.01)
*A45D 40/26* (2006.01)
(Continued)

(52) U.S. Cl.
CPC ..... *A45D 40/267* (2013.01); *A45D 34/045* (2013.01); *A45D 34/06* (2013.01);
(Continued)

(58) Field of Classification Search
CPC .... A46B 5/0008; A46B 5/0012; A45D 34/045
(Continued)

(56) References Cited

U.S. PATENT DOCUMENTS 5,121,763 A * 6/1992 Kingsford ..... A45D 40/28 132/317
5,620,270 A 4/1997 Gueret et al.
(Continued)

FOREIGN PATENT DOCUMENTS

EP 0162722 A2 11/1985
FR 2678494 A1 1/1993
(Continued)

OTHER PUBLICATIONS

Jan. 30, 2014—(WO) International Search Report—PCT/EP2013/077868.

*Primary Examiner* — David Walczak
*Assistant Examiner* — Joshua Wiljanen
(74) *Attorney, Agent, or Firm* — Banner & Witcoff, Ltd.

(57) ABSTRACT

This relates to a cosmetic product applicator comprising, along the same longitudinal axis, a mascara portion and an applicator portion, the mascara portion comprising a longitudinal sleeve along a longitudinal axis and an applicator end piece at a distal end of the sleeve, the applicator portion comprising a longitudinal rod and an applicator end at a distal end of the rod, the sleeve being dimensioned so as to be able to accommodate the longitudinal rod at least in part, the mascara portion and the applicator portion being able to be joined together and detached from one another, characterised in that the applicator end piece comprises a housing which is dimensioned so as to allow the applicator end to pass therethrough at least in part when the mascara portion is joined to the applicator portion.

14 Claims, 8 Drawing Sheets

(51) Int. Cl.

| | |
|---|---|
| ***A45D 34/04*** | (2006.01) |
| ***A45D 40/18*** | (2006.01) |
| ***A45D 40/24*** | (2006.01) |
| ***A46B 9/02*** | (2006.01) |
| *A46B 5/00* | (2006.01) |

(52) U.S. Cl.
CPC ..... *A45D 40/18* (2013.01); *A45D 40/24* (2013.01); *A45D 40/265* (2013.01); *A46B 9/021* (2013.01); *A46B 5/0008* (2013.01); *A46B 5/0012* (2013.01); *A46B 2200/1053* (2013.01)

(58) Field of Classification Search
USPC ..... 401/17, 18, 22, 24, 126, 127, 129
See application file for complete search history.

(56) References Cited

U.S. PATENT DOCUMENTS

| | | | | |
|---|---|---|---|---|
| 6,213,660 | B1 | 4/2001 | Waller et al. | |
| 2011/0297173 | A1* | 12/2011 | Anderson ..... | A45D 40/18 132/218 |
| 2012/0170963 | A1 | 7/2012 | Lou | |
| 2014/0307012 | A1 | 10/2014 | Kishi et al. | |

FOREIGN PATENT DOCUMENTS

| | | | |
|---|---|---|---|
| FR | 2724095 | A1 | 3/1996 |
| JP | 2002085151 | A | 3/2002 |
| JP | 5680218 | B2 | 3/2015 |
| KR | 200459832 | Y1 | 4/2012 |

* cited by examiner

TWO-PART APPLICATOR FOR A COSMETIC PRODUCT

CROSS-REFERENCE TO RELATED APPLICATIONS

The present application is a U.S. National Phase filing of International Application No. PCT/EP2013/077868, filed on Dec. 20, 2013, 2013, designating the United States of America and claiming priority to French Patent Application No. 1262825, filed Dec. 27, 2012, and this application claims priority to and the benefit of the above-identified applications, which are both incorporated by reference herein in their entireties.

TECHNICAL FIELD

The present invention relates to the field of cosmetic product applicators, and more particularly to the field of mascara and eyeliner applicators.

PRIOR ART

Mascaras and eyeliners are cosmetic products for making up to the eyes in order to emphasise them. Mascaras are applied to the eyelashes to colour and extend them. Eyeliners are applied to the eyelid, at the base of the eyelashes, to outline or accentuate the contour of the eye.

Mascaras and eyeliners are generally presented separately in cosmetic product applicator assemblies comprising a container, having a generally tubular shape and a cap having an applicator which is inserted into the container when the applicator assembly is closed. A user wishing to apply makeup to their eyelashes and the contour of the eyes must therefore have two applicator assemblies, one for mascara and another for eyeliner.

However, there are applicator assemblies having two containers, a first container for mascara and a second container for eyeliner. These containers are closed by the same cap bearing two applicators extending longitudinally and collinearly relative to each other. Said two applicators are arranged at two opposite ends of the cap. One of the two applicators comprises a mascara applicator end piece, and the other an eyeliner applicator tip. Thus, when the two containers are closed by the cap, the applicator assembly comprises, along a longitudinal axis, the first container, the cap and the second container, one after the other.

A drawback of these applicator assemblies is the fact that they are relatively bulky, doubling the volume compared with an applicator assembly just for either mascara or eyeliner.

There are also applicator assemblies in which the applicator comprises both a mascara applicator end piece and an eyeliner applicator tip, the applicator end piece and the applicator tip being designed so as to be able to be inserted into the same container.

JP56-80218 describes a first example of such an applicator assembly. Said assembly comprises a cap forming a sleeve, from which extends an applicator formed by a rod, at the distal end of which a mascara applicator end piece is provided. An eyeliner applicator tip is provided at the distal end of the applicator end piece.

FR2678494 describes a second example of such an applicator assembly. Said applicator assembly comprises a cap forming a sleeve, from which extends an applicator formed by a tube and a rod which is accommodated in the tube. The tube bears at the distal end thereof a mascara applicator end piece, and the rod an eyeliner applicator tip. The applicator is designed such that the applicator tip has two positions: an extended position in which the applicator tip projects out of the applicator end piece, and a retracted position in which the applicator tip is accommodated inside the applicator end piece.

A drawback of these two types of applicator assembly is the fact that the application of the eyeliner is made difficult by the presence of the mascara applicator end piece, which obstructs the view of the eyelid to which the eyeliner is to be applied. In addition, the user has to be careful not to move the applicator too close to the eyelid in case said eyelid is coloured by the mascara applicator end piece.

FR2724095 describes an applicator assembly comprising a cap forming a sleeve, from which extends an applicator formed by a mascara portion for applying a mascara and an eyeliner portion for applying an eyeliner. The mascara portion comprises a tube and a mascara applicator end piece which is arranged at a distal end of the tube. The eyeliner portion comprises a rod and an applicator tip in the form of a felt tip for eyeliner which is arranged at a distal end of the rod. The mascara portion and the eyeliner portion can be joined together and detached from one another. The applicator assembly comprises two containers, a first container into which the applicator is inserted to load the applicator end piece with mascara, and a second container which is arranged in the cap and connected to the felt tip so as to load said felt tip with eyeliner by capillary action.

A drawback of this applicator assembly is the presence of a second container, which increases the bulkiness of the applicator assembly. Another drawback is the fact that the applicator end piece and the applicator tip are loaded by different containers. It is therefore possible that one of the containers will become empty before the other. Faced with such a situation, the user will hesitate to throw away the applicator assembly, because it can still be used as a mascara applicator assembly or as an eyeliner applicator assembly. The user must therefore acquire another applicator assembly which is either identical thereto or corresponds to the cosmetic product which has run out. The user will thus still find themselves with two applicator assemblies. Moreover, the loading by capillary action of the felt tip leads to a non-uniform distribution of the product on the felt tip. In addition, when filling the containers with the cosmetic products, two filling steps are required.

INTRODUCTION

An object of the present invention is to remedy at least one drawback of the prior art.

For this purpose, the invention proposes a cosmetic product applicator comprising, along the same longitudinal axis, a mascara portion and an applicator portion, the mascara portion comprising a longitudinal sleeve along a longitudinal axis and an applicator end piece at a distal end of the sleeve, the applicator portion comprising a longitudinal rod and an applicator end at a distal end of the rod, the sleeve being dimensioned so as to be able to accommodate the longitudinal rod at least in part, the mascara portion and the applicator portion being able to be joined together and detached from one another, characterised in that the applicator end piece comprises a housing which is dimensioned so as to allow the applicator end to pass therethrough at least in part when the mascara portion is joined to the applicator portion.

Such an applicator makes it possible to have an applicator assembly acting both as a mascara applicator assembly and a second applicator assembly, such as a second mascara applicator assembly or an eyeliner applicator assembly.

Such an applicator also makes it possible to design a more compact applicator assembly, since only one container is required. In addition, when the single container is empty, the user can simply dispose of the applicator assembly and obtain another one. Thus they only ever need one applicator assembly.

Such an applicator also makes it possible to provide only one filling step, since only one container has to be filled.

In addition, during use, the applicator can simply unscrew either the applicator portion or the mascara portion (thus taking the applicator portion along with it). Thus, if the user only needs either the applicator portion or the mascara portion, they only have to carry out a single unscrewing movement.

The user can also leave the mascara portion fixed to the container and use only the applicator portion, thereby making it possible to protect the mascara portion against any soiling.

In a particular embodiment, the sleeve is a tube into which the longitudinal rod can be inserted along the longitudinal axis.

In a variant of the embodiment above, the sleeve is a channel, into the hollow of which the longitudinal rod can be inserted along the longitudinal axis and/or laterally.

In a particular embodiment, when the mascara portion and the applicator portion are joined together, the applicator end is located at a distal end of the applicator end piece and outside thereof.

In a particular embodiment, the applicator end piece is open-worked and, when the mascara portion and the applicator portion are joined together, the applicator end is accommodated in the applicator end piece.

In a variant, when the mascara portion and the applicator portion are joined together, the applicator has two positions, a first position in which the applicator end is accommodated in the applicator end piece and a second position in which the applicator end is located at a distal end of the applicator end piece.

In a particular embodiment, the applicator can further comprise a handle which is in two portions, a first portion being included in the mascara portion, and a second portion being included in the applicator portion, the first portion and the second portion being able to be joined together and detached from one another. The handle can also form a cap for a cosmetic product container. In a first variant, the first portion can thus comprise a tapped portion, and the second portion can comprise a threaded portion for the joining and detachment thereof by screwing. In a second variant, the first portion comprises a threaded portion, and the second portion can comprise a tapped portion for the joining and detachment thereof by screwing.

In a particular embodiment, the applicator portion is an eyeliner portion. Advantageously, said applicator portion is an applicator tip.

In a particular embodiment, the applicator portion is a second mascara portion. Advantageously, said applicator end is a second applicator end piece, in particular a fibre brush.

In a particular embodiment, the applicator end piece comprises means for attachment to the sleeve.

In a particular embodiment, the applicator end piece is fixed to the sleeve by overmoulding. In particular, it is the sleeve which is overmoulded around the applicator end piece. Conversely, the applicator end piece can be overmoulded on the sleeve.

The means for attaching the applicator end piece to the sleeve and the fixing of the applicator end piece to the sleeve by overmoulding make it possible to fix the applicator end piece to the sleeve without deforming the applicator end piece. This is particularly advantageous for preventing the applicator end piece, which comprises the housing, from deforming, in particular in the case of force fitting the applicator end piece in the sleeve.

DRAWINGS

Other objectives, features and advantages will become apparent upon reading the following description with reference to the drawings given by way of non-limiting example, in which.

Figure 9:
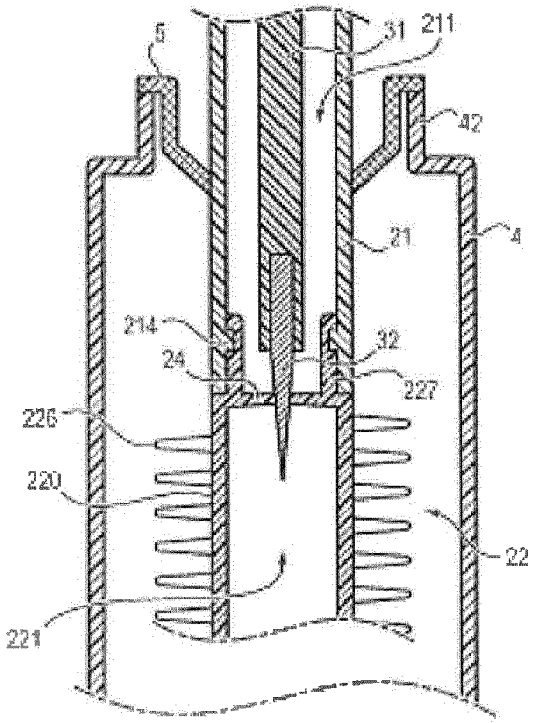
Figure 11:
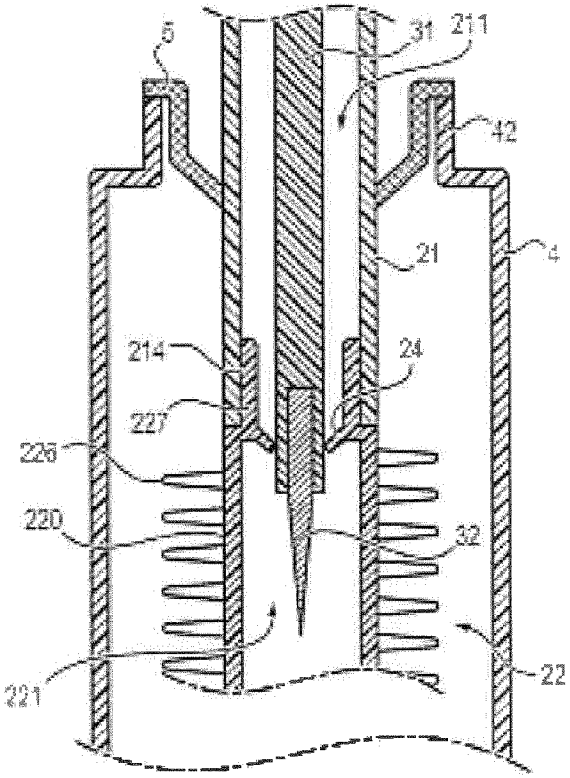
Figure 10:
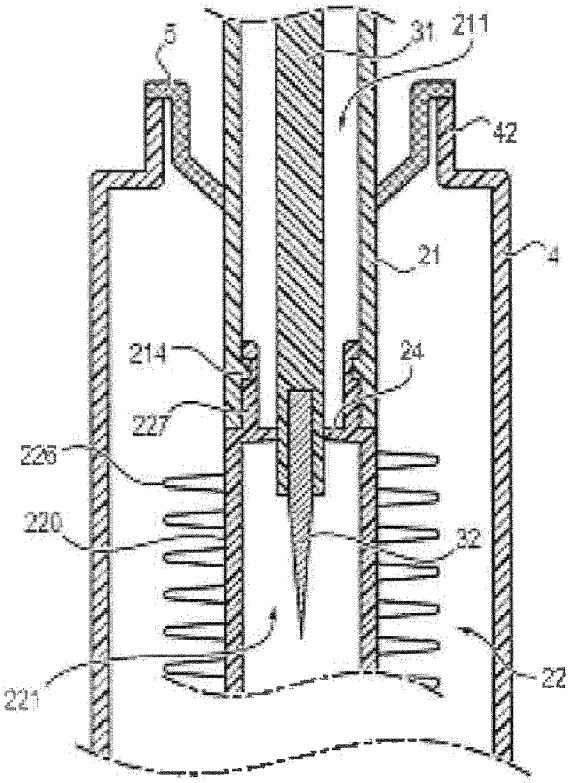
Figure 13:
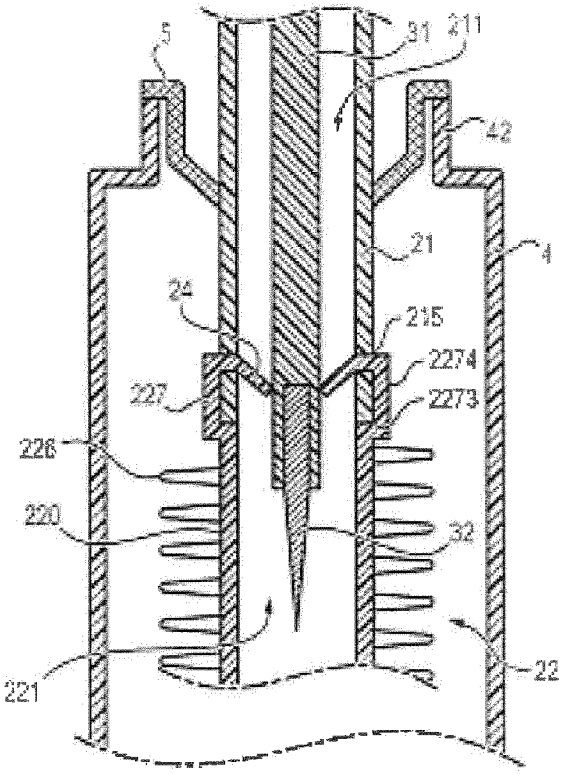
Figure 12:
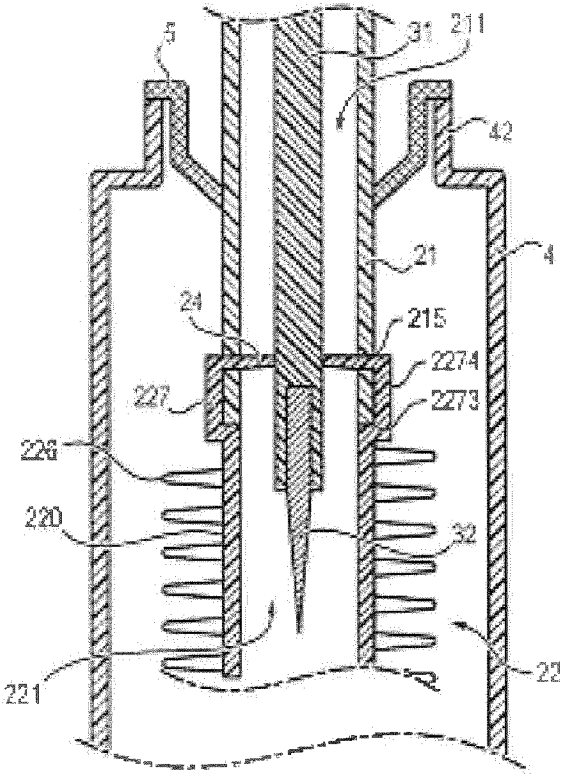
Figure 14:
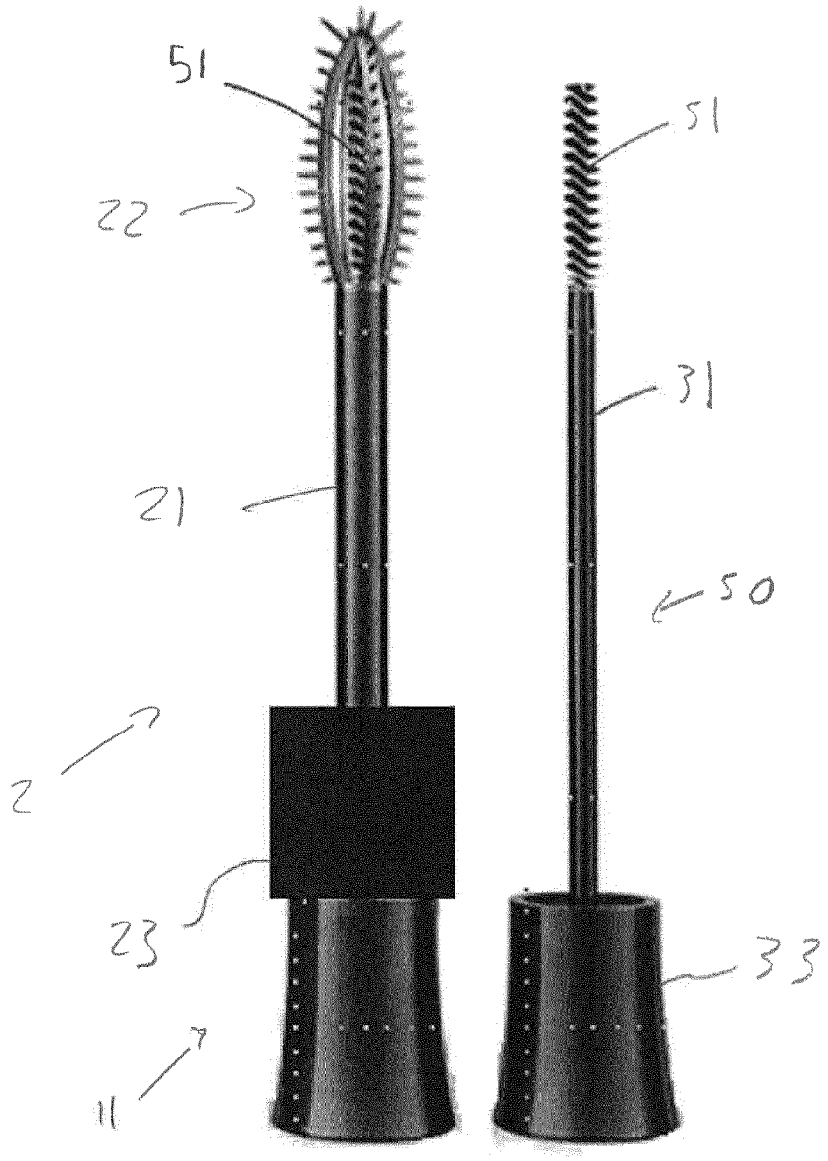

FIG. 9 is a schematic sectional view of an embodiment showing the mascara portion immersed in a cosmetic product container and the eyeliner portion inserted into the mascara portion, the applicator end piece comprising a planar annular wiper for the applicator tip and being fixed to the sleeve with a form fit by means of a circumferential groove on the outer surface of the fixing portion thereof and by means of a corresponding circumferential rib on the inner surface of the sleeve;

FIG. 10 is a schematic sectional view of another embodiment which is identical to the embodiment in FIG. 9, except for the fact that the applicator end piece comprises a wiper for the rod;

FIG. 11 is a schematic sectional view of another embodiment which is identical to that in FIG. 10, except for the fact that the annular wiper is frustoconical;

FIG. 12 is a schematic sectional view of another embodiment which is identical to that in FIG. 10, except for the fact that the applicator end piece is fixed to the sleeve by overmoulding of the fixing portion thereof through the attachment holes in the sleeve;

FIG. 13 is a schematic sectional view of another embodiment which is identical to that in FIG. 12, except for the fact that the annular wiper is frustoconical, and FIG. 14 is a perspective view of the applicator comprising the mascara portion and a second mascara portion.

DESCRIPTION

A cosmetic product applicator comprising, along the same longitudinal axis, a mascara portion and an applicator portion, in particular an eyeliner portion or a second mascara portion, is described below with reference to the drawings. The mascara portion 2 and the eyeliner portion 3 can be joined together and detached from one another.

In the rest of the description, the adjective "distal" relates to the portion of an element which is to be furthest away from the hand of the user when said user handles the applicator. The adjective "proximal" relates to the portion of an element which is to be closest to the hand of the user when said user handles the applicator.

In FIGS. 1 to 6, the applicator portion forms the eyeliner portion 3.

The eyeliner portion 3 of the applicator thus comprises a longitudinal rod 31 along the longitudinal axis and an applicator tip 32 at a distal end 311 of the rod.

The longitudinal rod 31 can be made of plastics material or metal.

The applicator tip 32 can be a brush, a flexible plastics strip, a felt tip or a sponge. The applicator tip 32 can be more or less flexible depending on the effect desired for the eyeliner. The applicator tip 32 can have a shape which is conical, bevelled, planar at the flat end, or in the form of a wedge.

The mascara portion 2 of said applicator comprises a longitudinal sleeve 21 along the longitudinal axis having a longitudinal aperture 211 and an applicator end piece 22 at a distal end 212 of the sleeve.

The sleeve 21 can be in the form of a tube 21 having dimensions which are selected in order to accommodate the longitudinal rod 31 at least in part. The dimensions can also be selected in order to allow the longitudinal rod 31 and the applicator tip 32 to be inserted inside the sleeve 21 along the longitudinal axis, for example the longitudinal rod 31 and the applicator tip 32 slides inside the sleeve 21.

The sleeve 21 can also be in the form of a channel, into the hollow of which the longitudinal rod 31 can be inserted along the longitudinal axis or laterally.

The applicator end piece 22 can comprise a hollow core 220 and protrusions 226 in the manner of conventional mascara applicator end pieces. The protrusions 226 can be arranged in multiple ways, depending on the desired combing effect.

The applicator end piece 22 can be made of plastics material with overmoulding of the protrusions 226 on the core 220. The protrusions 226 and the core 220 of the applicator end piece can also be integrally formed in one piece. The applicator end piece 22 comprises a housing 221 inside the hollow core 220 which is dimensioned so as to allow the applicator tip 32 to pass therethrough at least in part when the mascara portion 2 is joined to the eyeliner portion 3, and a proximal hole 224 at the proximal end 222 thereof, which hole opens into the housing 221. The housing 221 can also be dimensioned so as to allow the applicator tip 32 and also part of the longitudinal rod 31 to pass therethrough completely.

The applicator end piece 22 can comprise a distal hole 225 at the distal end 223 thereof, which hole opens into the housing 221. The length of the longitudinal rod is thus selected such that the applicator tip 32 is located at the distal end of the end piece when the mascara portion 2 and the eyeliner portion 3 are joined together. For example, the applicator tip 32 passes out of the housing 221 via the distal hole 225 in the applicator end piece. In a variant, the applicator tip 32 can stay inside the housing 221 when the mascara portion 2 and the eyeliner portion 3 are joined together. In this variant, the distal hole 225 makes it possible for the cosmetic product to pass inside the housing 221 to load the applicator tip.

The applicator end piece 22 can be open-worked, in particular when the length of the longitudinal rod 31 is selected such that the applicator tip 32 stays inside the housing 221 when the mascara portion 2 and the eyeliner portion 3 are joined together. Thus, the applicator end piece 22 comprises openings 228 which open into the housing 221. The cosmetic product can thus enter the housing 221 through said openings 228 and load the applicator tip 32.

In a first variant (see FIGS. 4 and 5), the applicator end piece 22 has an elongate general shape along the longitudinal axis, obtained for example by rotating an oval contour, including an elliptical contour, an oblong contour, or a hollow tube. The elongate general shape has at least one opening 228, preferably two or three openings 228, which are elongate along the longitudinal axis and extend from a proximal end of the applicator end piece to the distal end 223. The opening(s) 228 open into the housing 221. Such a shape also makes it possible to achieve flexibility of the applicator end piece, the walls of which can be deformed in a direction which is substantially perpendicular to the longitudinal axis. The applicator end piece can also comprise a distal hole 225 at the distal end 223 thereof as described above.

In a second variant, the hollow core 220 of the applicator end piece is in the shape of a tube which is elongate along the longitudinal axis and is in a lattice with a plurality of openings opening into the housing. The inside of the elongate tube forms the housing, and the outer surface thereof has the protrusions. The hollow core comprises open-worked wall portions and solid wall portions having protrusions, the solid wall portions being arranged alternately with the open-worked wall portions around the longitudinal axis.

More specifically, the core can comprise three open-worked wall portions and three solid wall portions. The solid walls are arranged with an angular spacing of approximately 120° therebetween. Similarly, the open-worked walls are arranged with an angular spacing of approximately 120° therebetween.

Each open-worked wall portion has a series of openings which are made through the wall and communicate with the housing. The solid wall portions have no openings.

The openings are diamond shaped and are oriented such that a diagonal of a diamond is parallel to the longitudinal axis, in the manner of a grid or lattice. The presence of the openings and of the distal opening optionally promotes circulation of the cosmetic product inside the applicator end piece.

Each solid wall portion has an elongate shape and extends in parallel with the longitudinal axis. The solid wall portions make it possible to stiffen the core, in particular to offset the flexibility of the open-worked wall portions.

On the solid portions, the protrusions are arranged in a plurality of longitudinal rows which each extend in parallel with the longitudinal axis.

The applicator end piece 22 can have a fixing portion at the proximal end thereof for the fixing thereof to the sleeve when the applicator end piece 22 and the sleeve are not produced as one single plastics material piece.

The applicator end piece 22 can thus be fixed to the sleeve 21 with a form fit, as is shown in FIGS. 9, 10 and 11. For example, the fixing portion 227 of the applicator end piece comprises a circumferential groove 2271 on the outer surface thereof. The sleeve 21 comprises, on the inner surface at the distal end thereof, a circumferential groove 214 having dimensions which correspond to those of the circumferential groove. The circumferential groove 2271 prevents translational relative movement of the applicator end piece 22 in relation to the sleeve in the direction of the length.

The fixing portion 227 can also comprise a longitudinal groove 2272 on the outer surface thereof. The sleeve 21 thus comprises a longitudinal rib having dimensions which correspond to those of the longitudinal groove. The longitudinal groove 2272 prevents relative rotational movement of the applicator end face 22 in relation to the sleeve.

Conversely, the outer surface of the fixing portion can have the circumferential rib and optionally the longitudinal groove, whilst the inner surface of the sleeve has the circumferential groove and optionally the longitudinal groove. Thus, the applicator end piece 22 comprises means, in particular the fixing portion 227, for attachment to the sleeve 21. The attachment can alternatively take place by overmoulding.

For example, in the variant shown in FIGS. 12 and 13, the fixing portion 227 can comprise a shoulder 2273 for accommodating the sleeve 21 and a ring 2274 for surrounding the distal end of the sleeve 21, the ring 2274 extending from the shoulder 2273. In this case, the sleeve can comprise attachment holes 215 which are arranged circumferentially for the overmoulding of the fixing portion 227 of the applicator end piece. Thus, the applicator end piece 22 is fixed in this case to the sleeve 21 by overmoulding. At said attachment holes, the plastics material of the ring 2274 of the applicator end piece 22 can adhere more effectively to the tube or to the channel forming the sleeve by penetrating therethrough. In this variant, a wiper 24, which will be described in greater detail below, can be produced in a continuous manner from the plastics material of the ring 2274 which penetrates inside the sleeve 21 into the aperture 211 thereof so as to form the wiper 24 for example in the form of a planar or frustoconical ring as described above.

The applicator 1 can further comprise a handle 11. The handle 11 is in two portions. A first portion 23 is included in the mascara portion 2, and a second portion 33 is included in the eyeliner portion 3. The first portion 23 and the second portion 33 of the handle can be joined together and detached from one another.

For example, the first portion 23 of the handle has a base 231 from which the sleeve 21 of the mascara portion extends. The base 231 of the first portion has an annular shape, the central hole of which is aligned with the inside of the longitudinal aperture 211 of the sleeve. The second portion 33 of the handle has a base 331 from which the rod 31 of the eyeliner portion extends.

Figure 1:
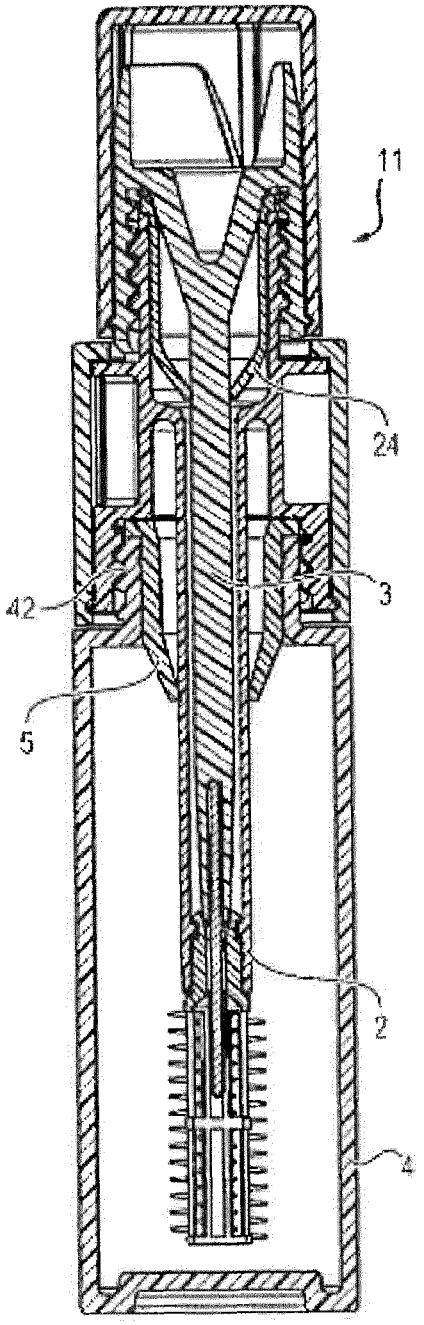
FIG. 1 is a sectional view of an applicator in two portions, comprising a mascara applicator end piece and an eyeliner applicator tip, the applicator being shown with the two portions thereof joined together and cooperating with a cosmetic product container.
Figure 3:
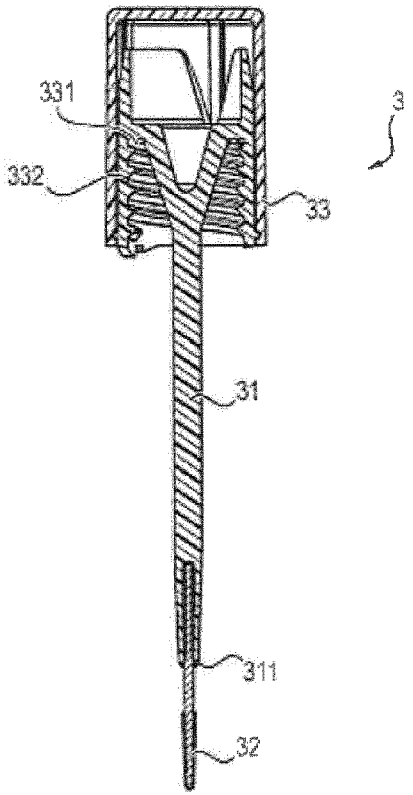
FIG. 3 is a sectional view of the eyeliner portion of the applicator from FIG. 1.
Figure 2:
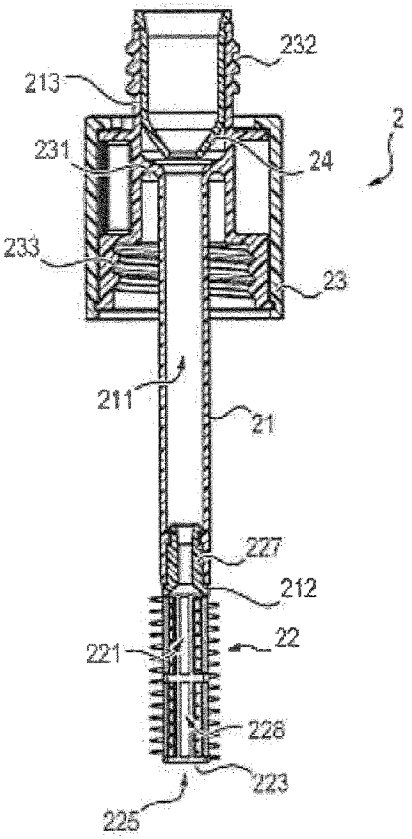
FIG. 2 is a sectional view of the mascara portion of the applicator from FIG. 1.
Figure 4:
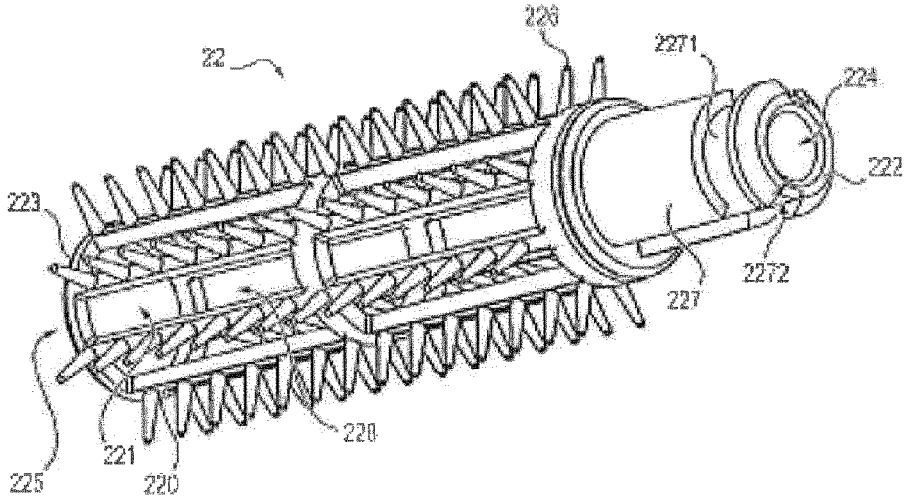
FIG. 4 is a three-quarter view of an applicator end piece having lateral openings opening into the housing and viewed from the proximal end thereof.
Figure 5:
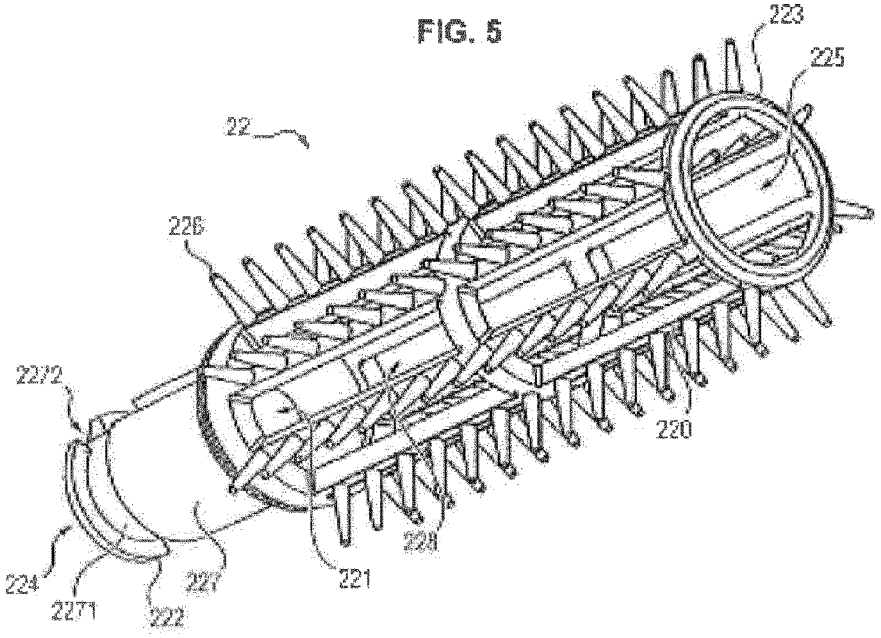
FIG. 5 is a three-quarter view of the applicator end piece from FIG. 4 viewed from the distal end thereof.
Figure 6:
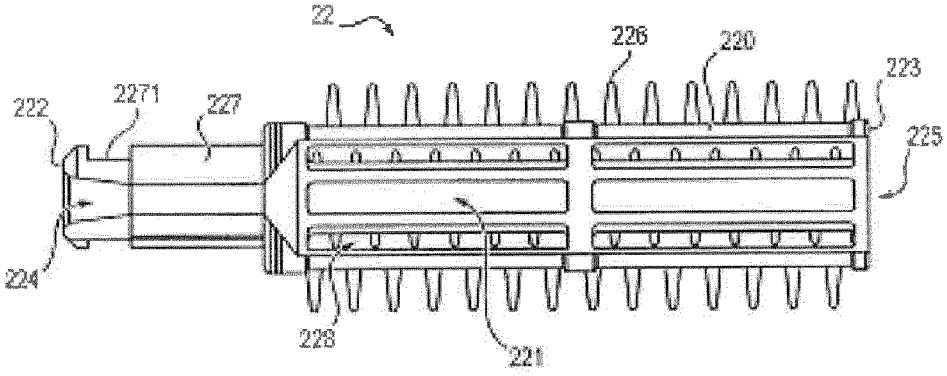
FIG. 6 is a sectional view of the applicator end piece from FIGS. 4 and 5.
Figure 7:
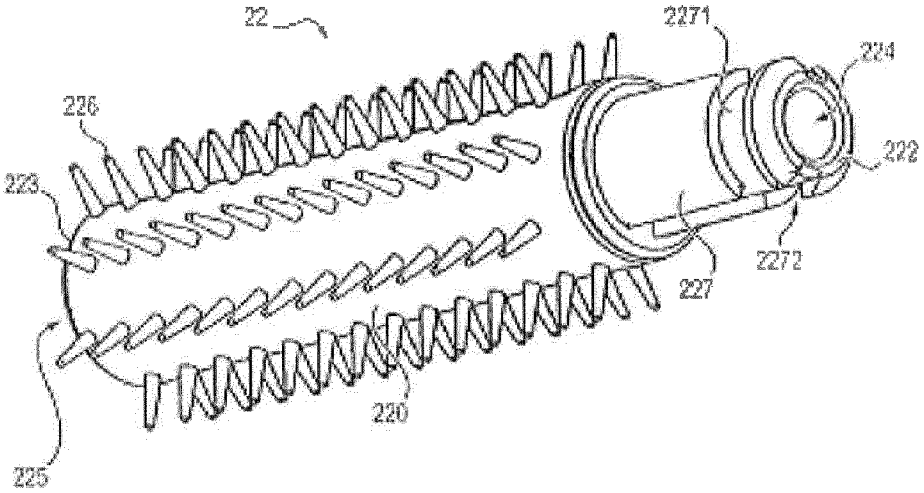
FIG. 7 is a three-quarter view of an applicator end piece without lateral openings and viewed from the proximal end thereof.
Figure 8:
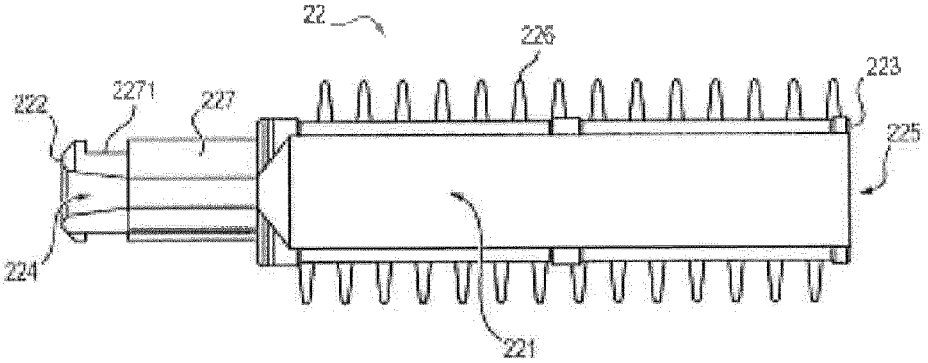
FIG. 8 is a sectional view of the applicator end piece from FIG. 7.

In a first variant, the first portion 23 further comprises a cylindrical wall 232 extending from the base for the fixing thereof to the second portion 33. The cylindrical wall 232 of the first portion and the sleeve 21 extend in two opposite directions. The outer surface of the cylindrical wall 232 of the first portion is threaded. The second portion 33 further comprises a cylindrical wall 332 which extends from the base 331. The cylindrical wall 332 of the second portion and the longitudinal rod 31 extend in the same direction. The inner surface of the wall of the second portion is tapped for the joining and detachment thereof by screwing to the outer surface of the wall of the first portion (as shown in FIGS. 1 to 3).

In a second variant, the first portion further comprises a cylindrical wall extending from the base. The cylindrical wall of the first portion and the sleeve extend in two opposite directions. The inner surface of the wall of the first portion is tapped. The second portion further comprises a cylindrical wall extending from the base. The cylindrical wall of the second portion and the rod extend in the same direction. The outer surface of the wall of the second portion is threaded for the joining and detachment thereof by screwing to the inner surface of the wall of the first portion.

Of course, the joining together and the detachment of the two portions from one another can be carried out by means other than screwing, for example by clipping together of the two portions or by magnets.

The handle 11 can also form a cap for a cosmetic product container 4. For this purpose, the handle 11 has a threaded outer surface or a tapped inner surface. The threaded outer surface or the tapped inner surface can be present on the first portion, the second portion or the two portions of the handle. Preferably, when the cap is closed on the container 4, the applicator is accommodated inside the container.

For this purpose, the first portion 23 of the handle comprises a cylindrical wall 233 extending from the base 231 thereof in the same direction as the sleeve 21 for the fixing thereof to the container. Said cylindrical wall 233 has a tapped inner surface for the fixing thereof to a neck 42 of the container 4 by screwing. Other types of fixing can replace the tapped inner surface to ensure the fixing of the cap to the neck 42 of the container for example by clipping together.

In order to allow the wiping of the applicator tip 32, a wiper 24 can be provided inside the sleeve 21, in the aperture 211 thereof, or in the first portion 23 of the handle which is connected to the mascara portion 2 of the applicator, or even to the inside of the applicator end piece 22. Thus, when the user detaches the eyeliner portion 3 from the mascara portion 2, the applicator tip 32 will pass through the wiper 24 before passing completely out of the mascara portion 2 and will be wiped thereby.

In the case in which the longitudinal rod 31 and the applicator tip 32 are inserted inside the sleeve 21 along the longitudinal axis, the wiper 24 can be arranged at a proximal end 213 of the sleeve, as shown in FIGS. 1 and 2.

In a variant, the wiper 24 can also be arranged at the distal end 212 of the sleeve, inside thereof. Thus, when in use, the applicator tip 32 is wiped before the passage thereof through the sleeve 21 for the application of the eyeliner. This thereby prevents clogging of the inside of the sleeve by the cosmetic product. In addition, this also makes it possible to wipe a distal portion of the longitudinal rod 31.

In the case in which the wiper 24 is arranged inside the sleeve 21, the wiper 24 and the sleeve 21 can be made of the same plastics material or of two different plastics materials. The wiper 24 is produced by injection or co-injection with the sleeve 21. The tube or channel forming the sleeve 21 can be overmoulded on the wiper 24 or conversely the wiper 24 can be overmoulded on the tube or channel forming the sleeve 21, in said latter case, the tube or channel has attachment functions allowing the plastics material of the wiper 24 to adhere more effectively to the tube or the channel by penetrating therethrough. The wiper 24 can be joined onto the tube or channel.

Alternatively, the wiper 24 can be arranged inside the applicator end piece, in the region of the proximal end 222 thereof (see FIGS. 9 to 13) or of the distal end 223 thereof. When in use, the applicator tip 32 is then wiped before passing through the sleeve 21 for the application of the eyeliner. This thereby prevents clogging of the inside of the sleeve by the cosmetic product. In addition, this also prevents the wiping of a distal portion of the longitudinal rod 31.

In the case in which the wiper 24 is arranged inside the applicator end piece 22, the wiper 24 and the applicator end piece 22 can be made of the same plastics material or of two different plastics materials. The wiper 24 can be produced by injection or co-injection with the applicator end piece 22. The applicator end piece 22 can be overmoulded on the wiper 24 or conversely the wiper 24 can be overmoulded on the applicator end piece 22. The wiper 24 can be joined onto the applicator end piece 22. The wiper 24 can form the fixing portion of the wiper 24 and comprise the grooves described above.

In a variant of the two cases above, the wiper 24, the sleeve 21 and the applicator end piece 22 can be made of the same plastics material or of two or even three different plastics materials. The wiper 24 can be produced with the sleeve 21 and the applicator end piece 22 by injection or co-injection. The wiper 24 can be produced with the sleeve 21, or the applicator end piece 22, in the above-described manner, then the applicator end piece 22, or the sleeve 21, is overmoulded or joined onto the whole formed by the wiper 24 and the sleeve 21, or the applicator end piece 22.

The wiper 24 can be a ring having a central wiping hole. The ring is made of a more or less flexible material. The flexibility of the ring and the diameter of the wiping hole are adapted to allow the applicator point 32 (see FIG. 9) and optionally also the rod 31 (see FIGS. 10 to 13) to pass therethrough. Thus, if the ring is stiff, the diameter of the wiping hole is equal to the maximum diameter of the applicator tip, and optionally of the rod. If the ring is flexible, the diameter of the wiping hole can be less than the maximum diameter of the applicator tip, and optionally of the rod, for better wiping thereof.

The ring can be planar (see FIGS. 9, 10 and 12), or frustoconical (see FIGS. 11 and 13). If the ring is frustoconical, it thus has effectively two holes, a hole having a larger diameter and a hole having a smaller diameter. The wiping hole corresponds to the hole having a smaller diameter. The frustoconical ring is arranged such that the hole thereof having a smaller diameter is in the distal position and the hole thereof having a larger diameter is in the proximal position.

In the case in which the tube or the channel forming the sleeve comprises attachment holes, the ring can be formed by the continuity of the plastics material of the fixing portion which penetrates the attachment holes inside the aperture of the sleeve (see FIGS. 12 and 13).

When the applicator tip 32 is received inside the housing 221 when the mascara portion 2 and the eyeliner portion 3 are joined together, the loading of the applicator end piece 22 and of the applicator tip 32 is carried out at the same point in the container 4. Thus, whatever the level of cosmetic product in the container 4, both the applicator end piece 22 and the applicator tip 32 can be loaded. There is no risk that the applicator end piece 22 will be loaded but the applicator tip 32 will not.

The applicator can still be designed such that it has two positions. In a first position, the applicator tip 32 is accommodated in the housing 221 of the applicator end piece. In a second position, the applicator tip 32 is located at a distal end of the applicator end piece 22, passing out of the housing 221 completely.

During the use of the applicator according to the invention, the user firstly applies mascara to the eyelashes with the applicator end piece 22. After having applied the mascara, the user removes the applicator tip 32, for example by unscrewing the second portion 33 of the handle and pulling the eyeliner portion 3 of the applicator to make the longitudinal rod 31 slide inside the sleeve 21. The user can then apply eyeliner to the eyelid, at the base of the eyelashes. In order to facilitate handling, before removing the eyeliner portion 3, the user can close the handle 11 forming the cap on the container 4 and unscrew only the second portion 33 of the handle.

The applicator is designed to cooperate with a container 4 for containing cosmetic product. The container 4 comprises a wall 41 which is closed at a first end and connected to a neck 42 having a threaded outer surface or a tapped inner surface. The selection of the threaded outer surface or the selection of the tapped inner surface depends on the handle of the applicator. If the handle 11 of the applicator has a threaded outer surface for coupling to the container, then the neck 42 of the container has a tapped inner surface and vice versa. When the handle 11 of the applicator is fixed to the neck 42 of the container, the applicator end piece 22 and/or the applicator tip 32 are located inside the container 4 for loading with cosmetic product.

The neck 42 further comprises an opening at the end thereof for the passage of the sleeve of the applicator at the second end thereof.

A wiper 5 is coupled to the container 4, in the vicinity of the opening, to wipe the applicator end piece 22. The applicator tip 32 itself is not wiped by said wiper 5, but the wiper 24 is arranged either in the sleeve 21 or in the applicator end piece 22. During the removal or the insertion of the applicator end piece 22, the sleeve 21 and the applicator end piece 22 slide through the wiper 5. In the closed position, the sleeve 21 passes through the wiper 5. Therefore, when the longitudinal rod 31 is arranged inside the sleeve 21, said rod also extends on either side of the wiper 5. As the above-described wiper 24 for the rod 31 and/or the applicator tip 32, the wiper 5 for the applicator end piece 22 can be a ring having a wiping hole at the centre thereof. Said ring is planar or frustoconical. The ring is arranged in the region of the neck of the container, inside thereof.

When the ring is frustoconical, it has two central holes: a hole having a larger diameter and a hole having a smaller diameter. The hole having a smaller diameter allows the wiping of the applicator end piece. In addition, it enters the space formed by the wall, such that the hole thereof having a smaller diameter is located in said space, and the hole thereof having a larger diameter is located in the region of the neck of the container.

According to a variant of the invention shown in FIG. 14, the applicator portion in this case is a second mascara portion 50. In this embodiment, said applicator end is, for example, a second applicator end piece 51. The second applicator end piece 51 in this case is a fibre brush. The user can thus choose from two different applicator end pieces for applying mascara from a single applicator to vary the sought effect of the make up as desired.

The invention claimed is:

1. Cosmetic product applicator comprising, along the same longitudinal axis, a mascara portion and an applicator portion, the mascara portion comprising a longitudinal sleeve along a longitudinal axis and an applicator end piece at a distal end of the sleeve, the applicator portion comprising a longitudinal rod and an applicator end at a distal end of the rod, the longitudinal sleeve being dimensioned so as to be able to accommodate the longitudinal rod at least in part, the mascara portion and the applicator portion being able to be joined together and detached from one another, wherein the applicator end piece comprises a hollow core and protrusions, the applicator end piece further comprising a housing inside the hollow core which is dimensioned so as to allow the applicator end to pass therethrough at least in part when the mascara portion is joined to the applicator portion, the applicator end piece comprising solid wall portions and open worked wall portions which open into the housing.

2. Applicator according to claim 1, wherein the sleeve is a tube into which the longitudinal rod can be inserted along the longitudinal axis.

3. Applicator according to claim 1, wherein the sleeve is a channel into the hollow of which the longitudinal rod can be inserted along the longitudinal axis.

4. Applicator according to claim 1, wherein, when the mascara portion and the applicator portion are joined together, the applicator end is located at a distal end of the applicator end piece and outside thereof.

5. Applicator according to claim 1, wherein the applicator end piece s open-worked and wherein, when the mascara portion and the applicator portion are joined together, the applicator end is accommodated in the applicator end piece.

6. Applicator according to claim 1, wherein, when the mascara portion and the applicator portion are joined together, the applicator has two positions, a first position in which the applicator end is accommodated in the applicator end piece and a second position in which the applicator end is located at a distal end of the applicator end piece.

7. Applicator according to claim 1, further comprising a handle in two portions, a first portion being included in the mascara portion, and a second portion being included in the applicator portion, the first portion and the second portion being able to be joined together and detached from one another.

8. Applicator according to claim 7, wherein the first portion comprises a tapped portion, and the second portion comprises a threaded portion for the joining and detachment thereof by screwing.

9. Applicator according to claim 7, wherein the first portion comprises a threaded portion, and the second portion comprises a tapped portion for the joining and detachment thereof by screwing.

10. Applicator according to claim 7, wherein the handle also forms a cap for a cosmetic product container.

11. Applicator according to claim 1, wherein the applicator portion is an eyeliner portion, said applicator end being an applicator tip.

12. Applicator according to claim 1, wherein the applicator portion is a second mascara portion, said applicator end being a second applicator end piece.

13. Applicator according to claim 1, wherein the applicator end piece comprises means for attachment to the sleeve.

14. Applicator according to claim 1, wherein the applicator end piece is fixed to the sleeve by overmoulding.

* * * * *